United States Patent [19]

Kadlubowski

[11] Patent Number: 4,973,933

[45] Date of Patent: Nov. 27, 1990

[54] DUAL CONTROL INFINITE SWITCH

[75] Inventor: Joseph C. Kadlubowski, Willowbrook, Ill.

[73] Assignee: Harper-Wyman Company, Lisle, Ill.

[21] Appl. No.: 484,345

[22] Filed: Feb. 22, 1990

[51] Int. Cl.[5] ..... H01H 37/52; H05B 3/02

[52] U.S. Cl. ..... 337/337; 219/486; 337/341; 337/361

[58] Field of Search ..... 337/337, 338, 340, 341, 337/343, 347, 360, 361, 334, 335; 219/358, 486, 485, 483, 510

[56] References Cited

U.S. PATENT DOCUMENTS 4,052,591 10/1977 Sekera, Jr. et al. ..... 337/361

*Primary Examiner*—H. Broome

*Attorney, Agent, or Firm*—Mason, Kolehmainen, Rathburn & Wyss

[57] ABSTRACT

An integral infinite switch is provided for controlling a first coil and a second coil of a radiant heating element. The integral infinite switch includes a first switch assembly for opening and closing an electrical path between a first AC electrical line L1 and a first end of the first coil. The first AC electrical line L1 is directly connected to a first end of the second coil. The integral infinite switch includes a second switch assembly for opening and closing an electrical path between a second AC electrical line L2 and a second opposite end of both the first coil and the second coil. A spindle is rotatable between an OFF position, a first range of ON positions for the second coil and a second range of ON positions for the first coil and the second coil. A cam member is mounted on the spindle for rotation with the spindle. The cam member includes a first cam surface adapted for operative engagement with the first switch assembly and a second cam surface adapted for operative engagement with the second switch assembly.

12 Claims, 3 Drawing Sheets

DUAL CONTROL INFINITE SWITCH

BACKGROUND OF THE INVENTION

1. Field of the Invention

The present invention relates to infinite switches and more particularly to an integral infinite switch for controlling a pair of coils of a radiant heating element of a stove or cooktop.

2. Description of the Prior Art

Infinite switches for cycle temperature control of stove heating elements are well known. An example of an infinite switch is disclosed by U.S. Pat. No. 4,052,591, issued Oct. 4, 1977 and assigned to the present assignee. The disclosure of U.S. Pat. No. 4,052,591 is incorporated herein by reference.

Dual coil radiant heating elements are being increasingly used for various cooktop applications. A dual coil heating element typically includes an inner low power coil, such as a 600 Watt rated coil for providing a low temperature range and an outer high power coil, such as a 1400 Watt rated coil used together with the inner coil for providing a high temperature range. A separate double pole single throw (DPST) secondary switch has been used in conjunction an infinite switch in a piggyback arrangement for controlling a dual coil radiant element. Disadvantages of this arrangement include the added complexity resulting from interconnecting the secondary switch, the additional space required for the generally bulky combination and the increased cost in manufacture. Further this is an uneconomical arrangement for use in a low-cost market where typically four such controls are needed for a stove.

SUMMARY OF THE INVENTION

Among the important objects of the present invention are to provide an integral infinite switch for controlling a dual coil radiant heating element without using a separate secondary switch; to provide an integral infinite switch making possible a simplified, less expensive and a small sized configuration; to provide an integral infinite switch providing effective and efficient control operation; and to provide an integral infinite switch that overcomes many of the disadvantages of prior art devices.

In brief, the objects and advantages of the present invention are achieved by an integral infinite switch for controlling a first coil and a second coil of a radiant heating element. The integral infinite switch includes a first switch assembly for opening and closing an electrical path between a first AC electrical line L1 and a first end of the first coil. The first AC electrical line L1 is directly connected to a first end of the second coil. The integral infinite switch includes a second switch assembly for opening and closing an electrical path between a second AC electrical line L2 and a second opposite end of both the first coil and the second coil. A spindle is rotatable between an OFF position, a first range of ON positions for the second coil and a second range of ON positions for the first coil and the second coil. A cam member is mounted on the spindle for rotation with the spindle. The cam member includes a first cam surface adapted for operative engagement with the first switch assembly and a second cam surface adapted for operative engagement with the second switch assembly. The first cam surface is engageable with the first switch assembly for opening an electrical path between the first AC electrical line L1 and the first end of the first coil responsive to rotation of the spindle to the first range of ON positions for the second coil. The 5 first cam surface is engageable with the first switch assembly for closing an electrical path between the first AC electrical line L1 and the second end of the first coil responsive to rotation of the spindle to the second range of ON positions for both the first coil and the second coil. The second cam surface includes a first inclined surface portion being engageable with the second switch assembly responsive to rotation of the spindle to the first range of ON positions for the second coil and a second inclined surface portion being engageable with the second switch assembly responsive to rotation of the spindle to the second range of ON positions for both the first coil and the second coil.

BRIEF DESCRIPTION OF THE DRAWINGS

The present invention together with the above and other objects and advantages may best be understood from the following detailed description of the embodiment of the invention illustrated in the drawings, wherein.

DETAILED DESCRIPTION OF THE PREFERRED EMBODIMENT

Figure 1:
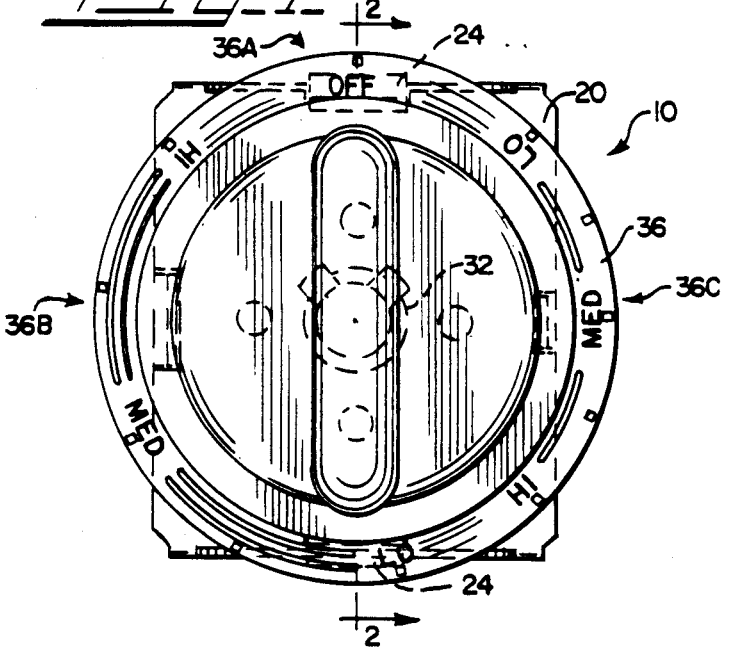
FIG. 1 is a front elevational view of an infinite switch constructed in accordance with the present invention.

Referring now to the drawings, in FIGS. 1–7, 5 there is illustrated an infinite switch constructed in accordance with the principles of the present invention and generally designated by the reference character 10. Infinite switch 10 provides efficient and reliable control of power applied to a pair of coils of a radiant heating element without requiring a separate secondary switch.

Figure 7:
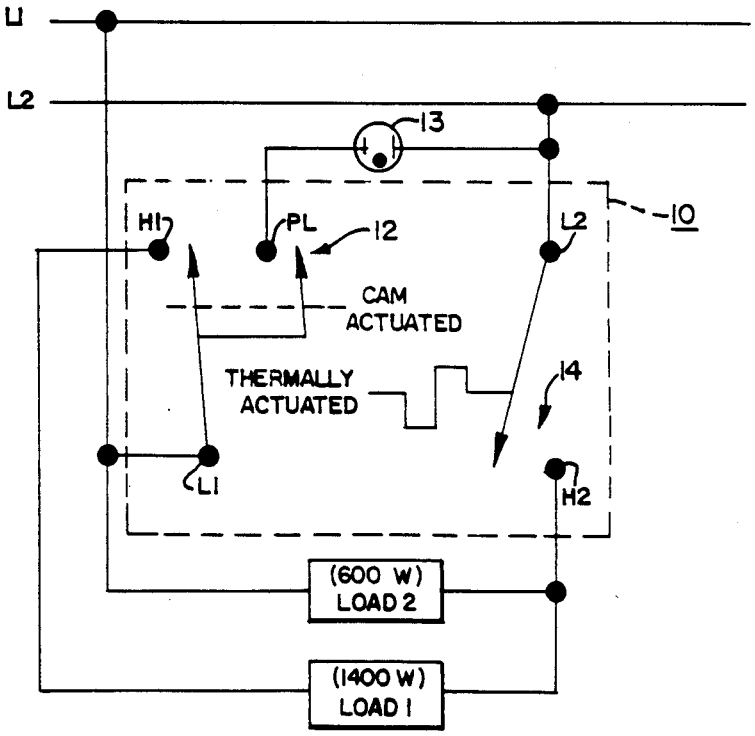
FIG. 7 is a schematic representation of the electrical circuit of the infinite switch of FIG. 1.

As indicated schematically in FIG. 7, the infinite switch 10 includes a first cam actuated dual switch assembly generally designated by 12. Switch assembly 12 controls the on-off condition of a first coil LOAD 1 of a pair of coils LOAD 1, LOAD 2 of a radiant heating element of a stove or cooktop (not shown) by closing and opening an electrical path between a first AC electrical line L1 and a first heating terminal H1 connected to a first end of the coil LOAD 1. The first AC electrical line L1 is directly connected to a first end of the coil LOAD 2. Switch assembly 12 separately controls the on-off condition of a pilot light 13 by closing and opening an electrical path between the first AC electrical line L1 and a pilot terminal PT connected to one side of the pilot light. The opposite side of the pilot light 13 is directly connected to a second AC electrical line L2. Switch assembly 12 closes an electrical path to turn-on the pilot light 13 when the infinite switch 10 is operated for applying power to the single coil LOAD 2 or to both coils LOAD 1, LOAD 2.

Figure 3:
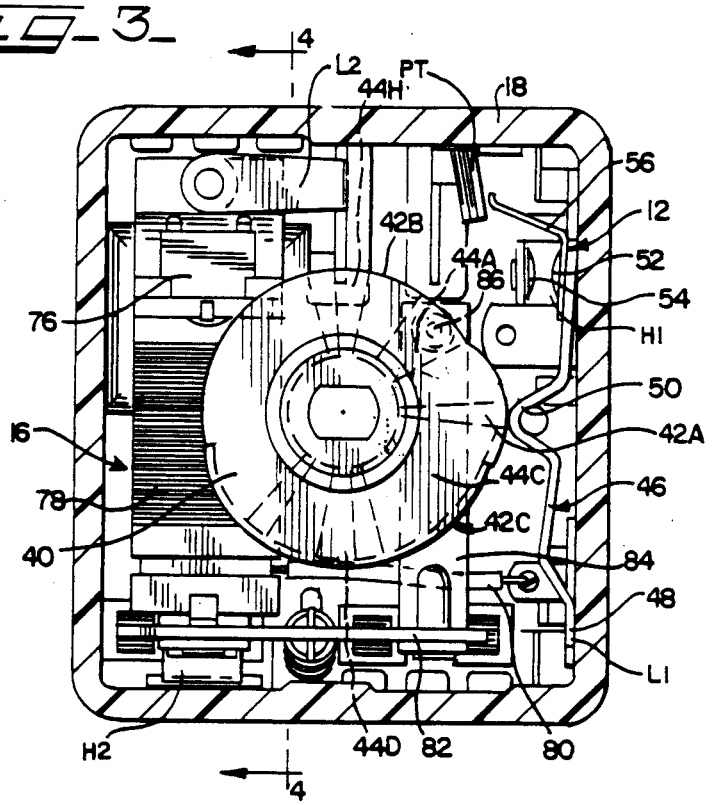
FIG. 3 is a cross-sectional view taken along the line 3—3 of FIG. 2.
Figure 4:
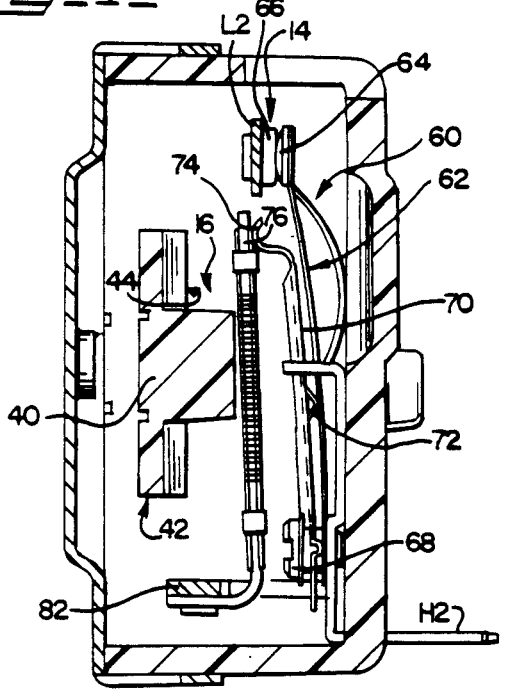
FIG. 4 is a cross-sectional view taken along the line 4—4 of FIG. 3.

Infinite switch 10 includes a second thermally activated switch assembly generally designated by 14 including a bimetal heater assembly generally designated by 16 (FIGS. 3–4). The second thermally actuated switch assembly 14 cyclically opens and closes an electrical path between the second AC electrical line L2 and a second heating terminal H2 connected to a second opposite end of both coils LOAD 1, LOAD 2 to maintain a particular user-selected temperature.

Figure 2:
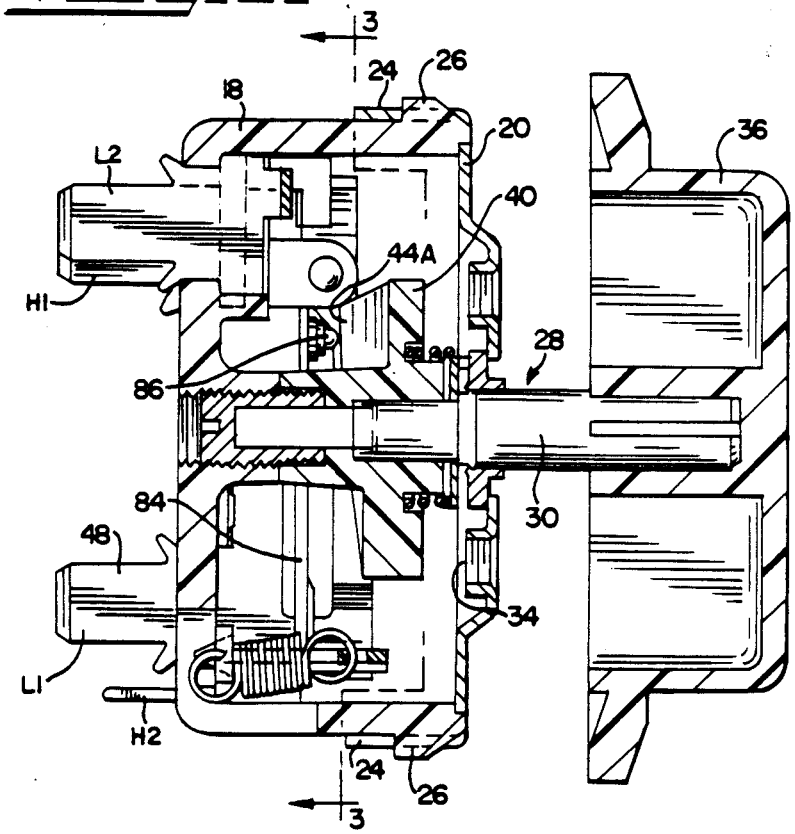
FIG. 2 is an enlarged cross-sectional view taken along the line 2—2 of FIG. 1.

Referring to FIGS. 1–2, the infinite switch 10 includes a housing 18 preferably formed by injection molding technique of an electrically nonconductive material. A front cover 20 is mechanically secured to an open face 22 of the housing 18. Front cover 20 includes upper and lower bails 24 positioned over a pair of corresponding lugs 26 molded on the housing 18 for snap-fit engagement of the cover 20 with the housing 18.

A push-to-rotate spindle assembly 28 includes a spindle 30 extending through a bushing 32 generally centrally disposed in a lock plate 34 secured to the front cover 20, for example, by welding or staking. A knob 36 is carried by the spindle 30 exterior of the housing 18 adapted for manual rotation by a user-operator. As indicated in FIG. 1, the knob carries indicia corresponding to an OFF position designated 36A, a first range of ON positions from LOW to HIGH generally designated 36B for both coils LOAD 1, LOAD 2 and a separate second range of ON positions from LOW to HIGH generally designated 36C for the single coil LOAD 2. Coil LOAD 2 has a lower wattage rating than coil LOAD 1, for example, a 600 watt rated coil can be used for coil LOAD 2 with a 1400 watt rated coil used for coil LOAD 1. Coil LOAD 2 typically is center coil disposed inside the higher wattage rated coil LOAD 1. The second range 36C advantageously is substantially less than the first range 36B to facilitate the desired heat or temperature level control.

In order to control the operation of the switch assemblies 12 and 14, a cam 40 is mounted on the spindle 28 for corresponding rotation with the spindle 28 responsive to user-operator manual rotation of the knob 32. Cam 40 is configured with first and second cam surfaces 42 and 44 for operative engagement with the switch assemblies 12 and 14 to control the on-off condition of the pilot light 13, coil LOAD 1, and cyclic on-off temperature level control the temperature level of the single coil LOAD 2 and both coils LOAD 1, LOAD 2.

Figure 5:
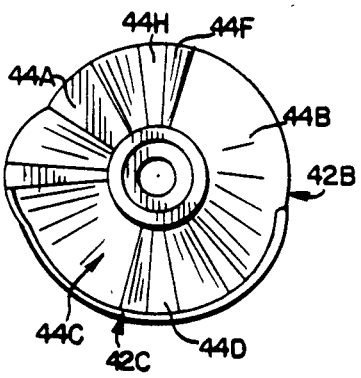
FIG. 5 is a plan view of a cam of the infinite switch of FIG. 1.
Figure 6:
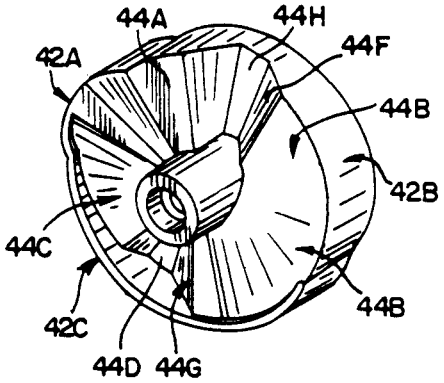
FIG. 6 is an enlarged perspective view of the cam of the infinite switch of FIG. 1.

Referring now to FIGS. 3, 5 and 6, the circumferential cam surface 42 of the cam 40 includes a plurality of cam surface control portions generally designated 42A, 42B and 42C utilized for controlling the contacting and noncontacting positions of the switch assembly 12. The switch assembly 12 includes an elongated switch arm 46 having a terminal blade portion 48 including the first AC electrical line terminal L1 (FIGS. 2 and 7), a cam follower portion 50 for operative engagement with cam surface 42 and a composite contact 52 for engagement with a composite contact 54 of the first heating contact H1. A contact arm extender 56 of the switch arm 46 is adapted for engagement with the pilot terminal PT.

In FIG. 3, the infinite switch 10 is shown in the OFF condition with the cam surface portion 42A of the cam 40 operatively engaging the cam follower portion 50 of switch arm 46 to open the contacts 54 and 56 and the contact arm extender 56 from the pilot terminal PT. Upon counter-clockwise rotation of the knob 36, the cam surface portion 42C operatively engages the cam follower portion 50 of switch arm 46 to maintain open the contacts 54 and 56 and the coil LOAD 1 deenergized. The contact arm extender 56 moves into abutting relationship with the pilot terminal PT to turn ON the pilot light 13 with cam surface portion 42C in engagement with cam follower portion 50. Upon further counter-clockwise rotation of the knob 36 or upon clockwise rotation of the knob 36 from the OFF position, the cam surface portion 42B is positioned adjacent the cam follower portion 50 permitting the contacts 54 and 56 to move into abutting relationship for completing an electrical path to energize the coil LOAD 1. The contact arm extender 56 is maintained in abutting relationship with the pilot terminal PT so that the pilot light 13 remains ON 5 with cam surface portion 42B in positioned adjacent the cam follower portion 50.

Heating coil LOAD 2 or both coils LOAD 1, LOAD 2 are energized in a cyclic manner by the operation of the thermally actuated switch assembly 14 responsive to the bimetal heater assembly 16 to maintain a particular user selected temperature.

Referring also FIGS. 2 and 4, switch assembly 14 includes a snap spring assembly 60 including a snap spring 62 carrying a composite contact 64 for cycling into contacting and noncontacting engagement with a composite contact 66 mounted by the second AC electrical line terminal L2. The snap spring assembly 60 is fixedly secured to the housing 18 by a snap spring retaining stud 68 together with a lever 70. A boss 72 of the lever 70 abuts the snap spring 62. An upper portion 74 of the lever 70 abuts a bimetal controller 76 carrying a heater wire 78 connected to the terminal L1 via an insulated wire 80. The bimetal controller 76 of the bimetal heater assembly 16 is staked or otherwise fixedly secured to a support plate 82 also supporting a bimetal compensator 84. A compensator cam follower 86 carried by the bimetal compensator 84 operatively engages the cam surface 44 of the cam 40.

As shown in FIGS. 2–3, the cam 40 is positioned in an OFF position with the switch assembly 14 disconnecting both coils LOAD 1, LOAD 2. In the OFF position, a cam surface portion 44A of the cam 40 engages the compensator cam follower 86 effective for holding the composite contacts 64 and 66 open. Upon counterclockwise rotation of the spindle 30 which effects corresponding rotation of the cam 40, an inclined cam surface portion 44C engages the compensator cam follower 86. The inclined cam surface portion 44C is graduated at a predetermined inclination so that rotation of the cam 40 predetermines the duration of the cycle of energization of the heating 5 coil LOAD 2 increasing from a predefined LOW temperature level. A predetermined maximum temperature level or maximum ON cycle for coil LOAD 2 is provided by rotation of the cam 40 to position a deepest cam surface portion 44D in abutting relationship with the compensator cam follower 86. Cam surface portion 44D is disposed at approximately 135° rotation from the OFF position. Upon further counterclockwise rotation of the cam 40 after a short transition area 44G, an inclined cam surface portion 44B engages the compensator cam follower 86 similarly for controlling the duration of the cycle of energization of both of the heating coils LOAD 1 and LOAD 2 increasing from a predefined LOW temperature level. A uniform motion cam surface is provided by each inclined cam surface portions 44B and 44C. A transition ramp surface portion 44F is provided between the inclined cam surface 44B and a maximum cycle duration or HIGH temperature position 44H for both coils LOAD 1 and LOAD 2. The predefined HIGH temperature position 44H is accessed upon further counterclockwise rotation of the cam 40 with a maximum cycle of energization for both coils LOAD 1 and LOAD 2.

Alternatively, the user-operator can turn the knob 36 clockwise from the OFF position 36A to access the HIGH heat operation of both coils LOAD 1, LOAD 2.

While the invention has been described with reference to details of the illustrated embodiment, these details are not intended to limit the scope of the invention as defined in the appended claims.

I claim:

1. In combination an integral infinite switch connected to an AC line controlling a first coil and a second coil of a radiant heating element comprising:

first switch means for opening and closing an electrical path between a first AC electrical line L1 and a first end of said first coil; said first AC electrical line connected to a first end of said second coil;

second switch means for opening and closing an electrical path between a second AC electrical line L2 and a second opposite end of both said first coil and said second coil;

a spindle being rotatable between an OFF position, a first range of ON positions for said second coil and a second range of ON positions for said first coil and said second coil;

a cam member mounted on said spindle for rotation with said spindle, said cam member having first cam surface means for operative engagement with said first switch means and second cam surface means for operative engagement with said second switch means;

said first cam surface means being engageable with said first switch means for opening an electrical path between said first AC electrical line L1 and said first end of the first coil responsive to rotation of said spindle to said first range of ON positions for said second coil, said first cam surface means being engageable with said first switch means for closing an electrical path between said first AC electrical line L1 and said second end of the first coil responsive to rotation of said spindle to said second range of ON positions for both said first coil and said second coil, and said second cam surface means including a first inclined surface portion being engageable with said second switch means responsive to rotation of said spindle to said first range of ON positions for said second coil and a second inclined surface portion being engageable with said second switch means responsive to rotation of said spindle to said second range of ON positions for both said first coil and said second coil.

2. An integral infinite switch as recited in claim 1 wherein said first cam surface means includes a circumferential cam surface.

3. An integral infinite switch as recited in claim 1 wherein said first switch means include a contact arm extender means for opening and closing an electrical path with a pilot light terminal.

4. An integral infinite switch as recited in claim 1 wherein said first inclined surface portion and said second inclined surface portion is operatively engaged with said second switch means for varying the proportion of cycling between open and closed positions.

5. An integral infinite switch as recited in claim 1 wherein said first inclined surface portion and said second inclined surface portion comprise a uniform motion cam surface.

6. An integral infinite switch as recited in claim 1 wherein each said first inclined surface portion and said second inclined surface portion is graduated at a predetermined inclination.

7. An integral infinite switch as recited in claim 1 wherein each said first inclined surface portion and said second inclined surface portion is disposed at a preselected angular range.

8. An integral infinite switch as recited in claim 1 wherein said first inclined surface portion has a smaller angular range than said second inclined surface portion.

9. An integral infinite switch as recited in claim 1 wherein said second switch means comprises a snap spring assembly including a bimetal heater controller and a bimetal compensator.

10. An integral infinite switch as recited in claim 9 wherein said first inclined surface portion and said second inclined surface portion operatively engages a compensator cam follower mounted by said bimetal compensator.

11. An integral infinite switch as recited in claim 1 further comprising a housing and wherein said first switch means, said second switch means and said cam member are positioned within said housing.

12. An integral infinite switch as recited in claim 11 further comprising a cover mounted to said housing and wherein a portion of said spindle extends through an opening in said cover and outside said housing accessible for manual rotation.

* * * * *